US011360414B2

(12) United States Patent
Ishihara et al.

(10) Patent No.: US 11,360,414 B2
(45) Date of Patent: Jun. 14, 2022

(54) SHEET CORRECTING DEVICE AND PRINTER

(71) Applicant: Ricoh Company, Ltd., Tokyo (JP)

(72) Inventors: Hiroki Ishihara, Kanagawa (JP); Genichiroh Kawamichi, Kanagawa (JP); Satoshi Aizawa, Ibaraki (JP); Kohki Asada, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 434 days.

(21) Appl. No.: 16/181,626

(22) Filed: Nov. 6, 2018

(65) Prior Publication Data

US 2019/0204767 A1 Jul. 4, 2019

(30) Foreign Application Priority Data

Dec. 28, 2017 (JP) ..... JP2017-254718
Aug. 24, 2018 (JP) ..... JP2018-157583

(51) Int. Cl.
*G03G 15/00* (2006.01)
*G03G 15/20* (2006.01)

(52) U.S. Cl.
CPC ..... *G03G 15/2039* (2013.01); *G03G 15/6576* (2013.01)

(58) Field of Classification Search
CPC ..... G03G 15/6576
USPC ..... 399/406
See application file for complete search history.

(56) References Cited

U.S. PATENT DOCUMENTS 5,539,511 A * 7/1996 Wenthe, Jr. ..... B65H 29/12 162/270
7,319,838 B2 * 1/2008 Baba ..... G03G 15/2053 399/323
7,489,895 B2 * 2/2009 Tani ..... B41J 11/002 399/329
2008/0031664 A1 * 2/2008 Yagi ..... G03G 15/2053 399/333
2008/0181687 A1 * 7/2008 Ishino ..... G03G 15/2064 399/329
2008/0247797 A1 * 10/2008 Yoshino ..... B65H 29/12 399/406
2010/0310287 A1 * 12/2010 Mikutsu ..... G03G 15/6573 399/322

(Continued)

FOREIGN PATENT DOCUMENTS

JP 7-036327 2/1995
JP 10-031396 2/1998

(Continued)

*Primary Examiner* — Nguyen Q. Ha
(74) *Attorney, Agent, or Firm* — Xsensus LLP

(57) ABSTRACT

A sheet correcting device includes a plurality of curved surface members including curved surfaces, respectively, to deform a sheet along the curved surfaces, the plurality of curved surface members disposed along a conveyance direction of the sheet, a plurality of pressing members disposed facing the curved surfaces of the plurality of curved surface members, respectively, to press the sheet against the curved surfaces of the plurality of curved surface members, respectively, a sheet tensioner to apply tension to the sheet, and a heater to heat the sheet that is bent by the curved surfaces of the plurality of curved surface members.

17 Claims, 12 Drawing Sheets

(56) References Cited

U.S. PATENT DOCUMENTS

| | | | | |
|---|---|---|---|---|
| 2011/0140357 | A1* | 6/2011 | Komatsu | B65H 5/26 271/270 |
| 2014/0029995 | A1* | 1/2014 | Okuda | G03G 15/6573 399/341 |
| 2014/0232797 | A1 | 8/2014 | Onodera et al. | |
| 2014/0308058 | A1* | 10/2014 | Ikeda | G03G 15/2021 399/341 |
| 2016/0101635 | A1 | 4/2016 | Hoshino et al. | |
| 2017/0157951 | A1 | 6/2017 | Onodera | |
| 2017/0266990 | A1 | 9/2017 | Yoshinuma et al. | |
| 2017/0266991 | A1 | 9/2017 | Onodera et al. | |
| 2017/0334217 | A1 | 11/2017 | Yoshinuma et al. | |
| 2018/0009237 | A1 | 1/2018 | Sakamoto et al. | |
| 2018/0198936 | A1* | 7/2018 | Kajiyama | G03G 15/6576 |
| 2018/0203398 | A1* | 7/2018 | Ishida | G03G 15/6582 |
| 2018/0264803 | A1 | 9/2018 | Hoshino et al. | |
| 2018/0264848 | A1 | 9/2018 | Nagasawa et al. | |
| 2018/0264849 | A1 | 9/2018 | Kitaoka et al. | |

FOREIGN PATENT DOCUMENTS

| | | |
|---|---|---|
| JP | 11-073071 | 3/1999 |
| JP | 2008-265987 | 11/2008 |
| JP | 2010-167592 | 8/2010 |
| JP | 2014-184711 | 10/2014 |
| JP | 2016-107519 | 6/2016 |
| JP | 2018-012323 | 1/2018 |
| JP | 2018-066552 | 4/2018 |

* cited by examiner

SHEET CORRECTING DEVICE AND PRINTER

CROSS-REFERENCE TO RELATED APPLICATIONS

This patent application is based on and claims priority pursuant to 35 U.S.C. § 119(a) to Japanese Patent Application No. 2017-254718, filed on Dec. 28, 2017 in the Japan Patent Office and Japanese Patent Application No. 2018-157583, filed on Aug. 24, 2018 in the Japan Patent Office, the entire disclosures of which are hereby incorporated by reference herein.

BACKGROUND

Technical Field

Aspects of the present disclosure relate to a sheet correcting device and a printer incorporating the sheet correcting device.

Related Art

When a liquid is applied to a sheet such as paper, a deformation of the sheet of paper called cockling (waving) or the like occurs due to localized swelling of the sheet to which the liquid is applied.

A drying apparatus is known that promotes drying of a liquid while suppressing cockling by conveying a continuous roll of paper in contact with a contact member having a predetermined curvature.

In addition, a device is known that holds a sheet between two endless belts and the device winds the sheet around a plurality of rollers to correct a curl.

SUMMARY

In an aspect of this disclosure, a novel sheet correcting device, includes a plurality of curved surface members including curved surfaces, respectively, to deform a sheet along the curved surfaces, the plurality of curved surface members disposed along a conveyance direction of the sheet, a plurality of pressing members disposed facing the curved surfaces of the plurality of curved surface members, respectively, to press the sheet against the curved surfaces of the plurality of curved surface members, respectively, a sheet tensioner to apply tension to the sheet, and a heater to heat the sheet that is deformed by the curved surfaces of the plurality of curved surface members. Each of the plurality of pressing members includes: a first pressing member to press the sheet against the curved surfaces, and a second pressing member separate from the first pressing member and disposed adjacent to and downstream of the first pressing member in the conveyance direction to press the sheet against the curved surfaces pressed by the first pressing member.

In another aspect of this disclosure, a sheet correcting device, includes a first curved surface member including first curved surface to contact one surface of a sheet with a first curved surface of the first curved surface member, a second curved surface member including a second curved surface to contact the one surface of the sheet with a second curved surface of the second curved surface member, the second curved surface member disposed downstream side of the first curved surface member in a conveyance direction of the sheet, a first pressing member facing the first curved surface of the first curved surface member to press the sheet against the first curved surface of the first curved surface member, a second pressing member separate from the first pressing member and disposed facing the second curved surface of the second curved surface member to press the sheet against the second curved surface of the second curved surface member, a sheet tensioner to apply tension to the sheet, and a heater to heat the sheet that is bent by the first curved surface member and the second curved surface member.

BRIEF DESCRIPTION OF THE SEVERAL VIEWS OF THE DRAWINGS

The aforementioned and other aspects, features, and advantages of the present disclosure will be better understood by reference to the following detailed description when considered in connection with the accompanying drawings, wherein.

Figure 1:
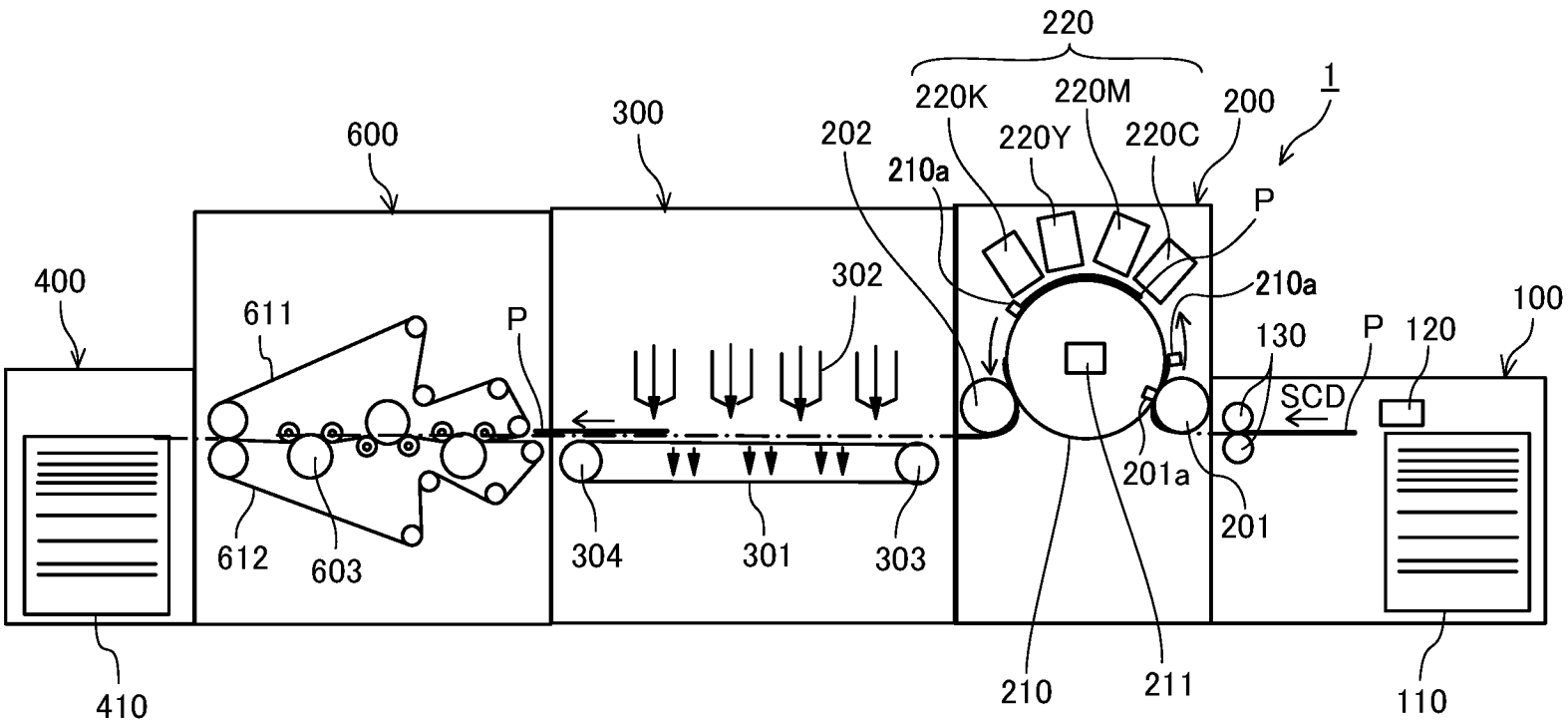
FIG. 1 is a schematic side view of a printer according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and all of the components or elements described in the embodiments of this disclosure are not necessarily indispensable. As used herein, the singular forms "a", "an", and "the" are intended to include the plural forms as well, unless the context clearly indicates otherwise.

Referring now to the drawings, wherein like reference numerals designate identical or corresponding parts throughout the several views, exemplary embodiments of the present disclosure are described below.

First, a printer according a first embodiment of the present disclosure is described with reference to FIG. 1. It is to be noted that the term "printer" in the present application is not limited to an ink jet recording apparatus, but includes a liquid discharge head for discharge liquid towards the sheet P. The "printer" is not limited to an apparatus to discharge liquid to render visible meaningful images, such as letters or figures. Thus, for example, the "printer" may include an apparatus to form arbitrary images, such as patterns.

The "printer" can also include devices to feed, convey, and eject the material onto which liquid adheres. The "printer" can further include a pretreatment device to apply treatment liquid to the material before liquid is discharged onto the material and a post-treatment device to apply treatment liquid to the material after liquid is discharged onto the material.

Further, the term "liquid" includes any liquid having a viscosity or a surface tension that can be discharged from the liquid discharge head. However, preferably, the viscosity of the liquid is not greater than 30 mPa·s under ordinary temperature and ordinary pressure or by heating or cooling. More specifically, the "liquid" is, for example, solution, suspension, emulsion or the like that includes a solvent, such as water or an organic solvent, a colorant, such as a dye or a pigment, a functionalizing material, such as a polymerizable compound, a resin, or a surfactant, a biocompatible material, such as DNA, amino acid, protein, or calcium, edible materials, such as natural colorants, and the like. Such liquids can be used, for example, for inkjet inks, surface treatment liquids, and the like.

The "printer" may be an apparatus to relatively move the liquid discharge heads and the sheet P. However, the "printer" is not limited to such an apparatus. For example, the "printer" may be a serial head apparatus that moves the head, a line head apparatus that does not move the head, or the like.

Further, the term "liquid discharge head" represents a functional component to discharge and jet liquid from discharge orifices (nozzles). As an energy generating source to discharge liquid, a discharge energy generator, for example, a piezoelectric actuator (lamination-type piezoelectric element and thin-film piezoelectric element), a thermal actuator using an electrothermal transducer element, such as a heating resistor (element), or an electrostatic actuator including a diaphragm plate and opposed electrodes can be used. However, the energy generating source is not limited to any specific type and may be any other suitable discharge energy generator.

FIG. 1 is a schematic view of the printer 1 according to the first embodiment.

The printer 1 includes a loading device 100, a printing device 200, a drying device 300, a sheet correcting apparatus 600 including a sheet correcting device 601 (see FIG. 2) according to the present embodiment, and an ejection device 400. The printer 1 applies a liquid to a sheet P conveyed from the loading device 100 by the printing device 200 to perform required printing, dries the liquid adhering to the sheet P by the drying device 300, performs a sheet correction process on the sheet P, in which deformations such as cockling has occurred, by the sheet correcting apparatus 600, and ejects the sheet P to the ejection device 400.

The loading device 100 includes a loading tray 110 on which a plurality of sheets P is stacked, a feeding device 120 for separating and feeding the sheets P one by one from the loading tray 110, and a registration roller pair 130 to feed the sheet P to the printing device 200, respectively.

As the feeding device 120, any feeding device, such as a device using rollers or a device using air suction, can be used. The sheet P delivered from the loading tray 110 by the feeding device 120 is delivered to the printing device 200 by the registration roller pair 130 being driven at a predetermined timing after a leading edge of the sheet P reaches the registration roller pair 130.

The printing device 200 serves as a liquid application device to apply the liquid onto the sheet P. The printing device 200 includes a carrying drum 210 for carrying and conveying the sheet P on an outer peripheral surface of the carrying drum 210 and a liquid discharge unit 220 that discharges the liquid toward the sheet P carried on the carrying drum 210 to apply the liquid to the sheet P. The printing device 200 further includes a transfer cylinder 201 that receives the fed sheet P and transfers the sheet P to the carrying drum 210 and a delivery cylinder 202 that delivers the sheet P conveyed by the carrying drum 210 to the drying device 300.

The leading end of the sheet P conveyed from the loading device 100 to the printing device 200 is gripped by a sheet gripper 201*a* provided on a surface of the transfer cylinder 201 and is conveyed in accordance with the rotation of the transfer cylinder 201. The sheet P conveyed by the transfer cylinder 201 is delivered to the carrying drum 210 at a position facing the carrying drum 210.

A sheet gripper 210*a* is also provided on a surface of the carrying drum 210, and the leading end of the sheet P is gripped by the sheet gripper 210*a* of the carrying drum 210. A plurality of dispersed suction holes is formed on the surface of the carrying drum 210, and a suction airflow directed toward the interior of the carrying drum 210 is generated in each of the suction holes by a suction device 211.

Then, the sheet P delivered from the transfer cylinder 201 to the carrying drum 210 is gripped by the sheet gripper 210*a* of the carrying drum 210, sucked by the suction airflow onto the surface of the carrying drum 210, and conveyed to the delivery cylinder 202 as the carrying drum 210 rotates.

The liquid discharge unit 220 discharges liquids (ink) of four colors of C (cyan), M (magenta), Y (yellow), and K (black) to print an image. The liquid discharge unit 220 includes liquid discharge heads 220C, 220M, 220Y, and 220K that applies individual liquids of each color on the sheet P. The liquid discharge heads 220C, 220M, 220Y, and 220K may discharge special liquids of colors such as white, gold, silver, and the like and may also discharge a process liquid such as a surface coating liquid as necessary.

A discharge operation of the liquid discharge heads 220C, 220M, 220Y, and 220K of the liquid discharge unit 220 is controlled by drive signals corresponding to print information. When the sheet P carried by the carrying drum 210 passes through a region facing the liquid discharge unit 220, the liquid of each color is discharged from the liquid discharge heads 220C, 220M, 220Y, and 220K, and an image corresponding to the printing information is printed on the sheet P.

The drying device 300 serving as a drying apparatus includes a suction conveyance belt 301 for sucking and conveying the sheet P conveyed from the printing device 200 and a hot air blower 302 to blow hot air onto the sheet P conveyed by the suction conveyance belt 301 to dry the liquid on the sheet P, for example. The suction conveyance belt 301 is wound, for example, between the drive roller 303 and the driven roller 304 and is rotated by driving the drive roller 303.

The sheet P conveyed from the printing device 200 is received by the suction conveyance belt 301 and is then conveyed to pass through the hot air blower 302 and delivered to the sheet correcting apparatus 600 to be conveyed from the sheet correcting apparatus 600 to the ejection device 400.

When the sheet P passes through the hot air blower 302, the liquid on the sheet P is subjected to a drying process. As a result, the liquid component such as moisture in the liquid evaporates, and the colorant contained in the liquid is fixed on the sheet P.

When the dried sheet P passes through the sheet correcting apparatus 600, deformation such as cockling of the sheet P is corrected.

The ejection device 400 includes an ejection tray 410 on which a plurality of sheets P is stacked. The sheets P conveyed from the sheet correcting apparatus 600 are sequentially stacked and held on the ejection tray 410.

For example, the printer 1 may include a pre-processing unit to perform pre-processing of image formation on the sheet P. The pre-processing unit is disposed on an upstream side of the printing device 200. Further, the printer 1 may include a post-processing unit to perform post-processing of image formation on the sheet P on which the liquid is adhered. The post-processing unit is disposed between the sheet correcting apparatus 600 and the ejection device 400.

For example, the pre-processing unit may perform a pre-application process that applies a treatment liquid on the sheet P before the image formation. The treatment liquid reacts with ink to reduce bleeding of the ink to the sheet P. However, the content of the pre-processing is not particularly limited to the process as described above. Further, the post-processing unit may perform a sheet reversing process and a binding process for binding a plurality of sheets P, for example. The sheet reversing process reverses the sheet P, on which image is printed by the printing device 200, and conveys the reversed sheet P again to the printing device 200 to print on both sides of the sheet P.

In the printer 1, for example, the pre-processing unit that performs pre-processing on the sheet P is disposed upstream side of the printing device 200. Further, the post-processing unit that perform post-processing on the sheet P to which the liquid is adhered may be disposed between the drying device 300 and the ejection device 400.

Next, a sheet correcting device 601 according to a first embodiment that configures a sheet correcting apparatus 600 described above is described with reference to FIGS. 2 and 3.

Figure 2:
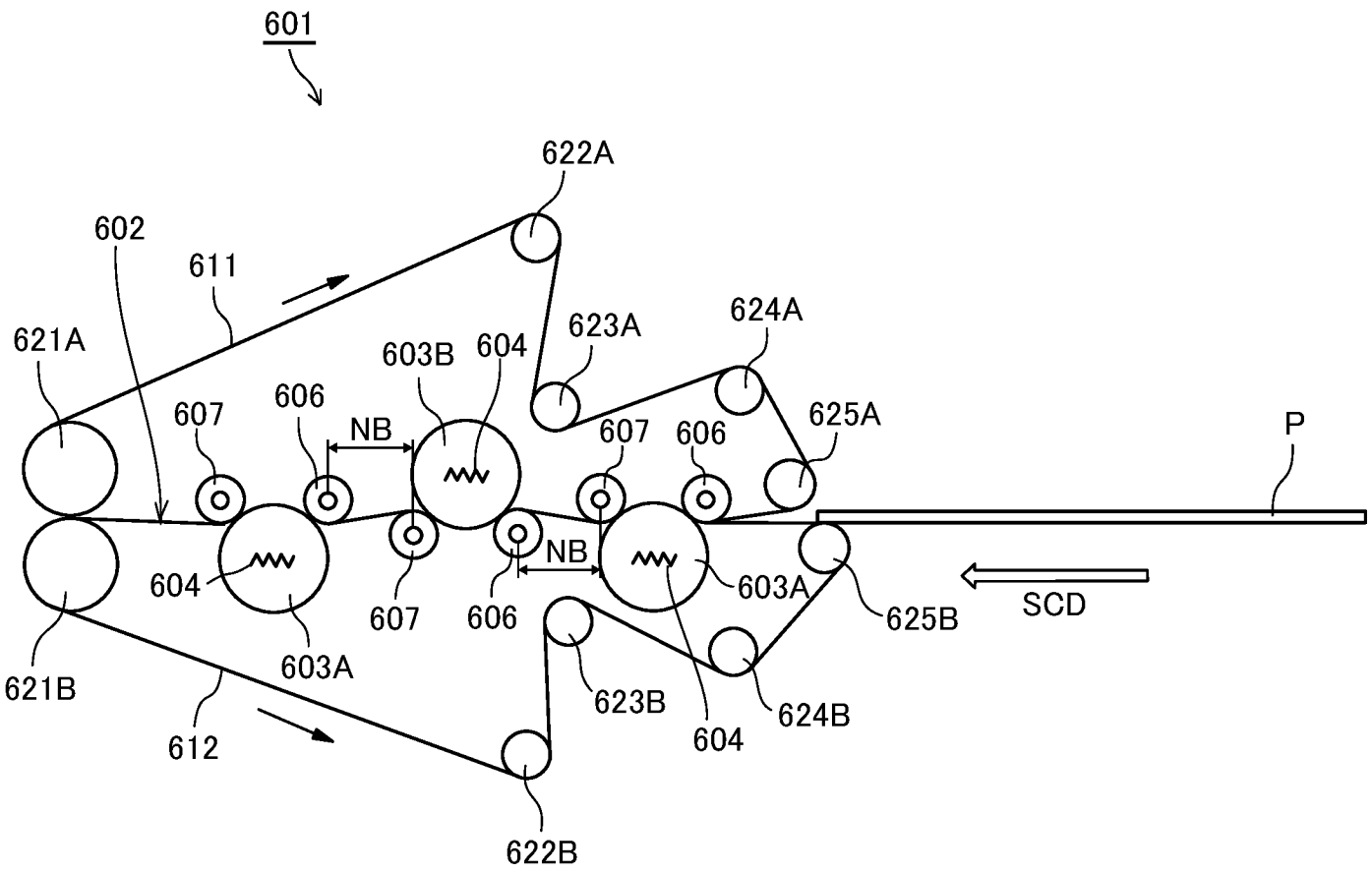
FIG. 2 is a schematic side view of a sheet correcting device according to the first embodiment of the present disclosure.
Figure 3:
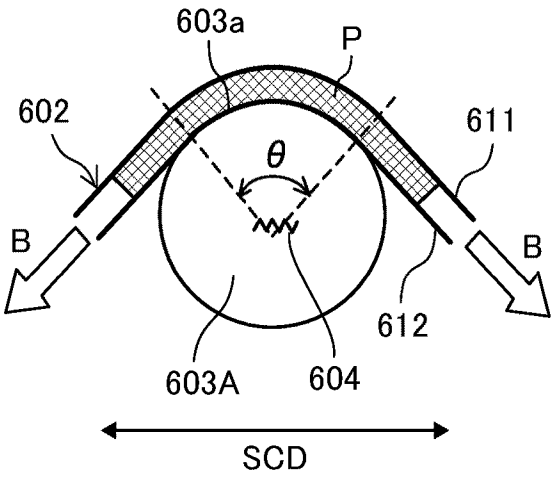
FIG. 3 is an enlarged cross-sectional view of a roller of the sheet correcting device according to the first embodiment.

FIG. 2 is a schematic side view of the sheet correcting device 601. FIG. 3 is an enlarged cross-sectional view of a roller 603 of the sheet correcting device 601 according to the first embodiment.

The sheet correcting device 601 includes a belt pair 602 as a means for applying tension to the sheet P. The belt pair 602 includes an endless upper belt 611 and a lower belt 612 that sandwich the sheet P between the upper belt 611 and the lower belt 612 and convey the sheet P.

The upper belt 611 is wound around a conveyance roller 621A, a steering control roller 622A, and driven rollers 624A and 625A, and is tensioned by the tension roller 623A.

The lower belt 612 is wound around a conveyance roller 621B, a steering control roller 622B, and driven rollers 624B and 625B, and is tensioned by the tension roller 623B.

The upper belt 611 and the lower belt 612 circulate in directions indicated by arrows in FIG. 2 by rotation of the conveyance rollers 621A and 621B so that the sheet P is sandwiched (nipped) and held by the upper belt 611 and the lower belt 612 and is conveyed in a "sheet conveyance direction" indicated by arrow "SCD".

Here, the tension rollers 623A and 623B serve as belt tensioners that apply a tensile force to each of the upper belt 611 and the lower belt 612, respectively. The tensile force acts in a direction in which the belt surface of the belt pair 602 sandwiching and holding the sheet P is simultaneously pulled toward the upstream side and the downstream side in the conveyance direction Y.

The sheet correcting device 601 includes a plurality (three in FIG. 2) of rollers 603A and 603B disposed along the sheet conveyance direction SCD of the sheet P. The plurality of rollers 603A and 603B are disposed where belt surfaces of the upper belt 611 and the lower belt 612 of the belt pair 602 face each other and sandwiches the sheet P. The plurality of rollers 603A and 603B contacts the upper belt 611 or the lower belt 612 of the belt pair 602. The rollers 603A and 603B deform a part of the belt pair 602 into a curved shape (bending).

Each of the rollers 603A and 603B includes a heater 604 serving as a heat generator inside each of the rollers 603A and 603B. The rollers 603A and 603B are heating rollers that also serve as heaters for heating a region of the sheet P in which the sheet P is pressed against the rollers 603A and 603B via the belt pair 602 and is deformed in the curved shape (bending).

Here, the rollers 603A and the roller 603B are alternately arranged where the belt surfaces of the upper belt 611 and the lower belt 612 face each other.

The belt pair 602 is bent to convex upward by pressing the lower belt 612 side of the belt pair 602 to the curved surface 603*a* (see FIG. 3) of the roller 603A. The belt pair 602 is bent to convex downward by pressing the upper belt 611 side of the belt pair 602 to the curved surface 603*a* of the roller 603B.

The belt pair 602 is bent to convex upward by the curved surface 603*a* (see FIG. 3) of the rollers 603A that press the lower belt 612 side of the belt pair 602 upward. The belt pair 602 is bent to convex downward by the curved surface 603*a* of the roller 603B that presses the upper belt 611 side of the belt pair 602 downward.

Thus, the rollers 603A that bends one surface of the sheet P convexly upward and the roller 603B that bends another surface of the sheet P convexly downward are alternately arranged in the sheet conveyance direction SCD of the sheet P. Note that the rollers 603A and 603B may be alternately arranged such that the roller 603B is arranged at the most upstream in the sheet conveyance direction SCD.

The sheet correcting device 601 further includes first pressing members 606 and second pressing members 607. The first pressing members 606 and the second pressing members 607 constitute pressing means that face the curved surfaces 603*a* (peripheral surfaces) of the rollers 603A and 603B and press the belt pair 602 against the curved surfaces 603*a* of the rollers 603A and 603. The first pressing members 606 and the second pressing members 607 are arranged along the sheet conveyance direction SCD. Here, the first pressing members 606 are arranged on the upstream side of each of the rollers 603A and 603B in the sheet conveyance direction SCD, and the second pressing members 607 are arranged on the downstream side of each of the rollers 603A and 603B in the sheet conveyance direction SCD. In other word, a pair of the first pressing member 606 and the second pressing member 607 faces and contacts each of the rollers 603A and 603B, and the first pressing member 606 is disposed upstream side of each of the rollers 603A and 603B, and the second pressing member 607 is disposed downstream side of each of the rollers 603A and 603B.

The first pressing members 606 determine a pressing start position (winding start position) at which the belt pair 602 starts contacting the curved surfaces 603*a* of the rollers 603A and 603B. The second pressing members 607 determine a pressing end position (winding end position) at which the belt pair 602 separates from the curved surfaces 603*a* of the rollers 603A and 603B.

The second pressing members 607 facing the upstream sides of the rollers 603A and 603B are separated from the first pressing members 606 facing the downstream sides of the rollers 603A and 603B, respectively, where each of curved surface members (rollers 603A and 603B) adjacent in the sheet conveyance direction SCD. The upstream side roller 603 (one of rollers 603A and 603B disposed upstream side) and the downstream side roller 603 (one of rollers 603A and 603B disposed downstream side of the upstream side roller 603) are arranged at an interval at which the belt pair 602 is not bent between the second pressing member 607 disposed upstream side and the first pressing member 606 disposed downstream side of the second pressing member 607.

Here, the roller 603 described above includes the rollers 603A and 603B. In other words, the belt pair 602 is held substantially straight between the second pressing member 607 disposed upstream side and the first pressing member 606 disposed adjacent to and downstream of the first pressing member 606. Thus, the belt pair 602 is held substantially straight between the rollers 603A and 603B. A region in which the belt pair 602 is not bent between the second pressing member 607 disposed on the upstream side and the first pressing member 606 disposed on the downstream side of the second pressing member 607 is indicated by NB in FIG. 2.

Thus, the sheet correcting device 601 can release stress of the belt pair 602, which is once bent along the curved surface 603*a* of the rollers 603A and 603B. Thus, the sheet correcting device 601 can improve adhesion of the belt pair 602 to the rollers 603A and 603B of a next-stage.

The first pressing members 606 and the second pressing members 607 are disposed to be movable toward and away from the curved surface 603*a* of the rollers 603A and 603B. As a result, a winding angle θ of the belt pair 602 on the curved surfaces 603*a* of the rollers 603A and 603B can be changed according to a thickness (type) of the sheet P and an amount of the liquid applied to the sheet P, and the like.

Figure 4:
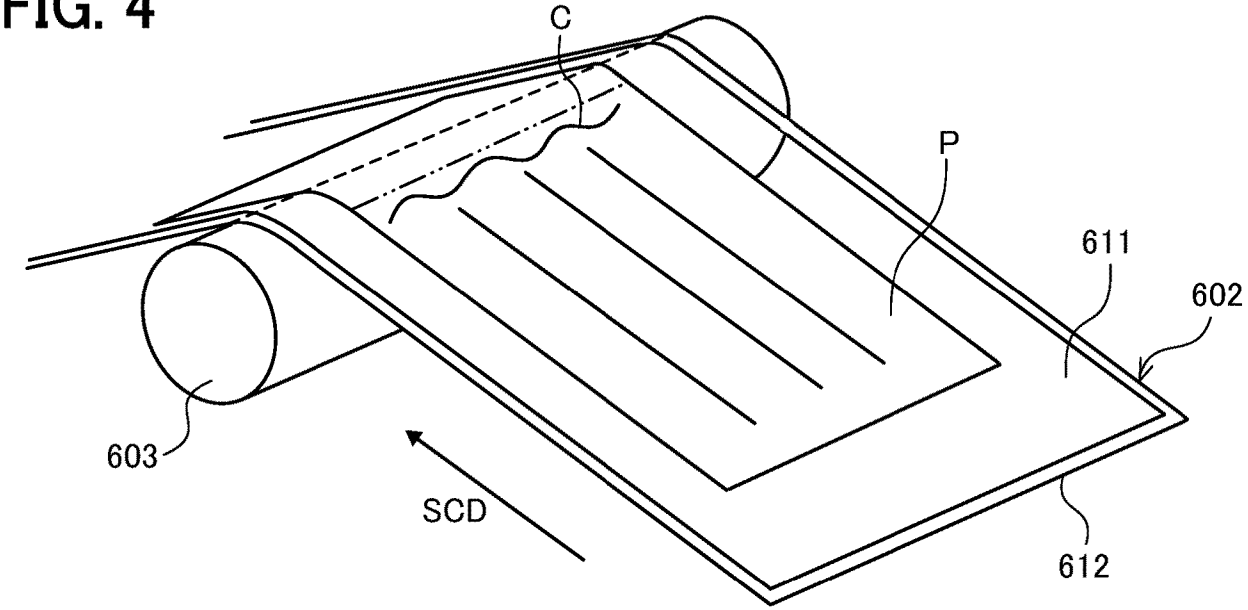
FIG. 4 is a perspective view of the roller of the sheet correcting device according to the first embodiment.

Next, the operation of the present embodiment is described with reference to FIG. 4. FIG. 4 is a perspective view of the roller 603A and the belt pair 602 in a state in which the sheet P sandwiched between the upper belt 611 and the lower belt 612 of the belt pair 602 is seen through the belt pair 602.

As illustrated in FIG. 4, when cockling (waving) C remains on the sheet P, the cockling (waving) disappears while the sheet P is wound around a curved surface such as the curved surface 603*a* of the roller 603A while applying tension to the sheet P. The cockling (waving) disappears because both of a portion of the sheet P on which the liquid is applied and swollen and a portion of the sheet P on which the liquid is not applied are tensioned and heated equally.

However, the cockling (waving) arises again and is not corrected when the tension is lost (not applied) if the sheet P is merely wound around the curved surface (peripheral surface 603*a*) of the roller 603 while applying tension to the sheet P without heating the sheet P.

The sheet correcting device 601 heats the sheet P with the heating means and squeezes the sheet P while evaporating the moisture in the sheet P. Thus, the sheet correcting device 601 can apply the tension and the heat equally to the portion of the sheet P on which the liquid is applied and the portion of the sheet P on which the liquid is not applied. Thus, the sheet correcting device 601 can correct the cockling (waving) of the sheet P.

That is, as illustrated in FIG. 3, the sheet P is sandwiched and held between the upper belt 611 and the lower belt 612 and is pressed against the curved surface 603*a* of the roller 603 serving as a heating roller in this sandwiched state. Thus, the belt pair 602 is deformed into a curved shape (bent upward) while the belt pair 602 holds the sheet P between the upper belt 611 and the lower belt 612.

At this time, a tension is applied to the upper belt 611 and the lower belt 612 by the tension rollers 623A and 623B (see FIG. 2) so that the upper belt 611 and the lower belt 612 are pressed against the curved surface 603*a* of the roller 603A as a heating roller in a direction indicated by arrow B in FIG. 3.

Further, the sheet P sandwiched between the upper belt 611 and the lower belt 612 is pressed against the curved surface 603*a* (peripheral surface) of the roller 603A as the heating roller while the tension is applied to the sheet P in the direction indicated by arrow B by friction between the sheet P and the upper belt 611 and the lower belt 612.

As a result, the sheet P is heated by the roller 603A and follows the curved surface 603*a* of the roller 603A. Thus, the sheet correcting device 601 can equally heats and apply tension to the portion of the sheet P on which the liquid is applied and the portion of the sheet P on which the liquid is not applied. Thus, the sheet correcting device 601 can correct the cockling (waving) of the sheet P.

In this manner, the sheet correcting device 601 presses the sheet P against a curved surface member (rollers 603A and 603B in the present embodiment) while applying tension to the sheet P to bent and deform the sheet P in a curved shape while heating the sheet P. Thus, the sheet correcting device 601 can correct the deformation such as cockling (waving) of the sheet P.

In the present embodiment, as illustrated in FIG. 2, the rollers 603A and 603B are disposed along the sheet conveyance direction SCD to contact a region in which the upper belt 611 and the lower belt 612 faces (region of the belt pair 602 sandwiching the sheet P). The rollers 603A and 603B are the heating rollers serving as a plurality of curved surface members.

As described above, the sheet P is heated by the heating means (rollers 603A and 603B) to evaporate the moisture in the sheet P while the sheet P is squeezed. Thus, the sheet correcting device 601 can equally heats and apply tension on the portion of the sheet P on which the liquid is applied and the portion of the sheet P on which the liquid is not applied. Thus, the sheet correcting device 601 can correct the deformation such as cockling (waving) of the sheet P.

In this case, a correcting effect of winding the sheet P around a plurality of curved members (rollers) for a plurality of times with small winding angles is larger than a correcting effect of winding the sheet P around a circumferential surface of one curved member (roller) with a large winding angle.

For example, an effect of correction of the cockling (waving) of the sheet P when the sheet P is wound around a roller having a diameter φ of 80 mm with a winding angle θ of 30 degrees for three times is larger than the effect of correction when the sheet P is wound around a roller having a diameter φ of 80 mm at a winding angle θ of 90 degrees for one time.

Thus, arranging the plurality of curved surface members in the sheet conveyance direction SCD can effectively correct the deformation such as cockling (waving) of the sheet P.

Thus, the rollers 603A that bends one surface of the sheet P convexly upward and the roller 603B that bends another surface of the sheet P convexly downward are alternately arranged in the sheet conveyance direction SCD of the sheet P. The roller 603A bends and deforms the belt pair 602 convexly upward, and the roller 603B bends and deforms the belt pair 602 convexly downward.

Thus, both surfaces of the sheet P are pressed against the rollers 603A and 603B so that the sheet P is alternately protrude (convex) upward and downward. Thus, the sheet correcting device 601 can reliably correct the deformation such as cockling (waving) of the sheet P while suppressing an occurrence of curling.

Next, a sheet correcting apparatus according to a second embodiment of the present disclosure is described with reference to FIGS. 5 and 6.

Figure 5:
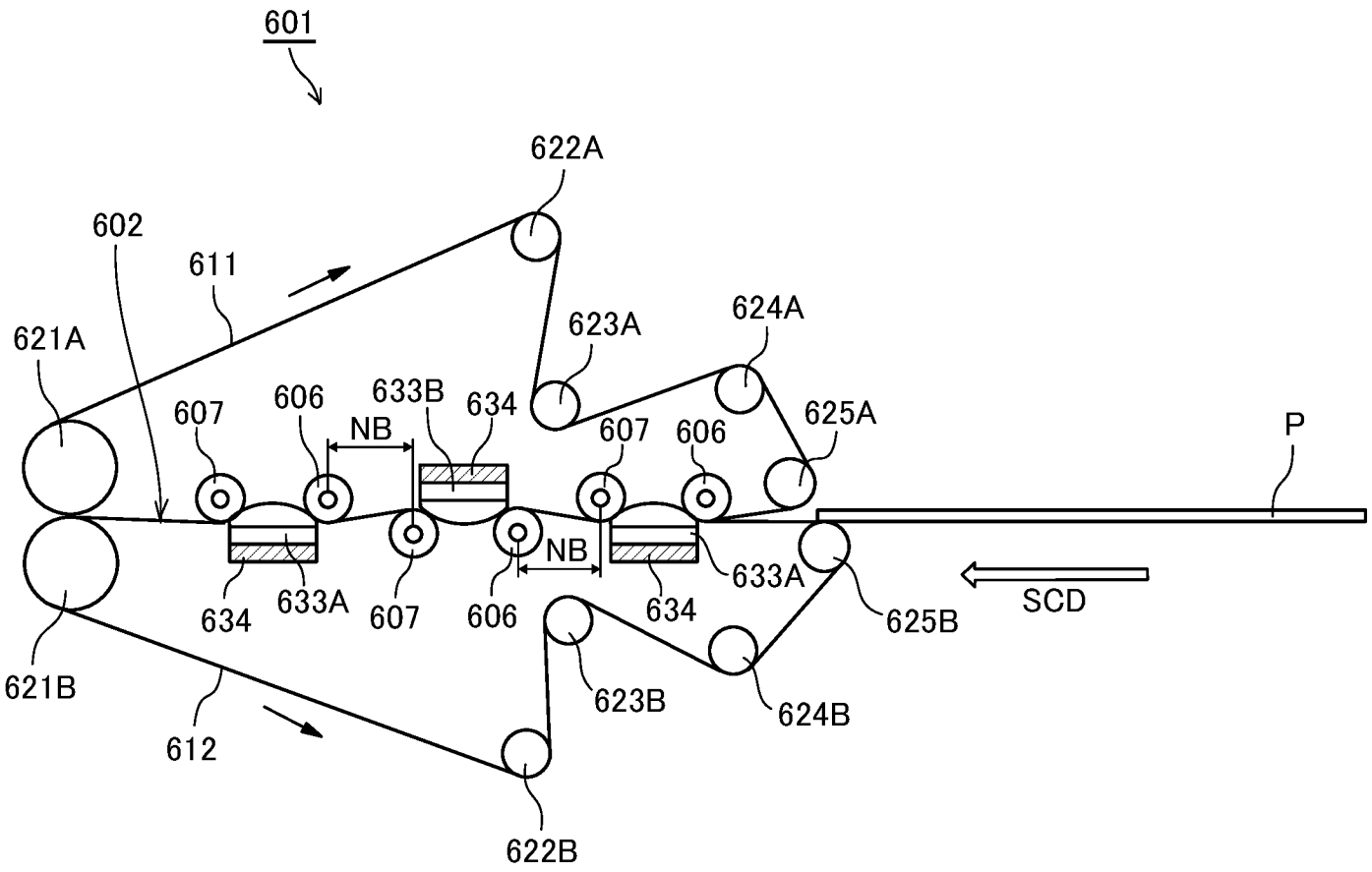
FIG. 5 is a schematic side view of a sheet correcting device according to a second embodiment of the present disclosure.

FIG. 5 is a schematic side view of the sheet correcting device 601. FIG. 6 is an enlarged cross-sectional view of a roller of the sheet correcting device according to the second embodiment.

In the present embodiment, a plurality of curved surface members 633 (633A and 633 B) has a substantially semi-circular cross-section and includes a curved surface 633*a* (see FIG. 6) contacting the upper belt 611 and the lower belt 612 of the belt pair 602 where the belt pair 602 sandwiches and holds the sheet P. The plurality of curved surface members 633 includes a heater portion 634 as a heat generator serving as a heating means for heating the sheet P.

Also in the present embodiment, the curved surface member 633A contacting the lower belt 612 and the curved surface member 633B contacting the upper belt 611 are alternately arranged where the belt surfaces of the upper belt 611 and the lower belt 612 of the belt pair 602 face each other and sandwich the sheet P to hold the sheet P.

The belt pair 602 is bent and deformed in a direction convex upward by the curved surface 633*a* of the curved surface member 633A that pushes the lower belt 612 of the belt pair 602 upward. The belt pair 602 is bent and deformed in a direction convex downward by the curved surface 633*a* of the curved surface member 633B that pushes the upper belt 611 of the belt pair 602 downward.

In other words, the curved surface member 633A that bends one side of the sheet P convexly upward and the curved surface member 633B that bends another side of the sheet P convexly downward are arranged alternately in the sheet conveyance direction SCD. The curved surface member 633A and the curved surface member 633B may be alternately arranged while the curved surface member 633B is disposed at the most upstream side in the sheet conveyance direction SCD.

In the present embodiment, the first pressing member 606 and the second pressing member 607 that constitute the pressing means are arranged along the sheet conveyance direction SCD.

The first pressing member 606 determines a pressing start position (winding start position) at which the belt pair 602 starts contacting the curved surface 633*a* of the curved surface member 633. The second pressing member 607 determines a pressing end position (winding end position) at which the belt pair 602 separates from the curved surface 633*a* of the curved surface member 633.

The second pressing members 607 facing the upstream side of one of the curved surface members 633A and 633B is separated from the first pressing members 606 facing the downstream side of the other of the curved surface members 633A and 633B where the curved surface members 633A and 633B adjacent in the sheet conveyance direction SCD. For example, the second pressing member 607 facing the most upstream side (right end in FIG. 5) of the curved surface member 633A is separated from the first pressing member 606 facing the downstream side (center in FIG. 5) of the curved surface member 633B in the sheet conveyance direction SCD.

Further, the second pressing member 607 facing the upstream side (center in FIG. 5) of the curved surface member 633B is separated from the first pressing member 606 facing the most downstream side (left end in FIG. 5) of the curved surface member 633A in the sheet conveyance direction SCD. Further, the curved surface member 633A and the curved surface member 633B are disposed at an interval in which the belt pair 602 does not bend (kept straight) between the second pressing member 607 and the first pressing member 606 that is disposed downstream side of the second pressing member 607.

Thus, the sheet correcting device 601 can release stress of the belt pair 602, which is once bent along the curved surfaces 633*a* of the curved surface members 633A and 633B. Thus, the sheet correcting device 601 can improve adhesion of the belt pair 602 to the curved surface members 633A and 633B of a next-stage.

Further, the first pressing member 606 and the second pressing member 607 similar to the first pressing member 606 and the second pressing member 607 in the first embodiment are arranged to be movable to face the curved surface members 633A and 633B.

Figure 6:
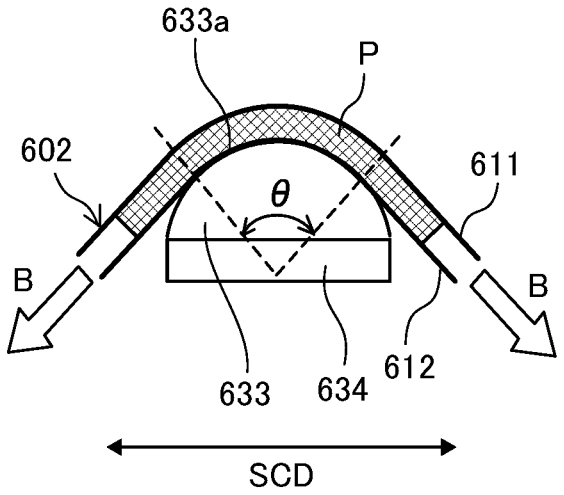
FIG. 6 is an enlarged cross-sectional view of a roller of the sheet correcting device according to the second embodiment.

In the present embodiment as well, as illustrated in FIG. 6, the sheet P sandwiched between the upper belt 611 and the lower belt 612 is pressed against the curved surface 633*a* of the curved surface member 633 serving as the heating means while the tension is applied to the sheet P in the direction indicated by arrow B by friction between the sheet P and the upper belt 611 and the lower belt 612.

As a result, the sheet P is heated by the curved surface member 633 and follows the curved surface 633*a* of the curved surface member 633. Thus, the sheet correcting device 601 can equally heats and apply tension on the portion of the sheet P on which the liquid is applied and the portion of the sheet P on which the liquid is not applied. Thus, the sheet correcting device 601 can correct the deformation such as cockling (waving) of the sheet P.

In this manner, the sheet correcting device 601 can efficiently correct the deformation of the sheet P by pressing the sheet P against a curved surface member (rollers 603A and 603B in the present embodiment) while applying tension to the sheet P to bent and deform the sheet P in a curved shape while heating the sheet P. Thus, arranging the plurality of curved surface members in the sheet conveyance direction SCD can effectively correct the deformation such as cockling (waving) of the sheet P.

Next, a sheet correcting device 601 according to a third embodiment of the present disclosure is described with reference to FIG. 7.

Figure 7:
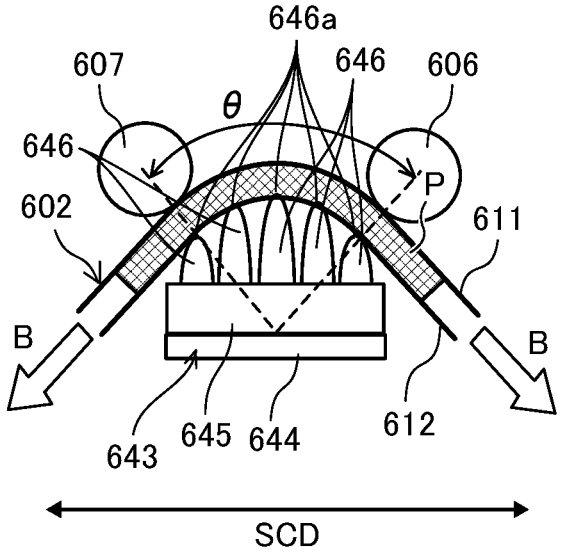
FIG. 7 is an enlarged cross-sectional view of a curved surface member of the sheet correcting device according to a third embodiment.

FIG. 7 is a cross-sectional view of a portion of one of plurality of the curved surface members of the sheet correcting device.

In the present embodiment, the plurality of curved surface members 643 includes a plurality of contact members 646 arranged in the sheet conveyance direction SCD of the sheet P. Each of the plurality of contact members 646 includes curved surface on a leading end of the plurality of contact members 646. A curved surface is formed by virtually connecting the leading ends of each of the plurality of contact members 646.

The plurality of contact members 646 is held on a base 645. The height of the plurality of contact members 646 from the base 645 is such that the leading end 646*a* of the contact member 646 at a center portion protrudes from the leading ends 646*a* of the contact members 646 at each end in the sheet conveyance direction SCD. For example, in FIG. 7, the leading end 646*a* of the contact member 646 at a center is disposed above the leading ends 646*a* of the contact members 646 at each end in the sheet conveyance direction SCD.

Similarly, the height of the plurality (five in FIG. 7) of contact members 646 decreases toward the downstream end (left end in FIG. 7) and decreases toward the upstream end (right end in FIG. 7) in the sheet conveyance direction SCD when the contact member 646 at the center is the start position. Thus, the height of the contact member 646 at the center is the highest among the heights of the plurality of contact members 646.

Thus, each of the plurality of curved surface members 643 includes a plurality of contact members 646 disposed along the sheet conveyance direction SCD, and a leading end of one of the plurality of contact members 646 disposed at a center in the sheet conveyance direction SCD protrudes beyond leading ends of the plurality of contact members 646 disposed at both ends in the sheet conveyance direction SCD.

The curved surface member 643 includes a heater as the heat generator 644 on the base 645 side, for example. The curved surface member 643 may include a heater built inside the contact member 646 also serving as heating means for heating the sheet P.

In the present embodiment as well, as illustrated in FIG. 7, the sheet P sandwiched between the upper belt 611 and the lower belt 612 is pressed against the plurality of contact members 646 while the tension is applied to the sheet P in the direction indicated by arrow B by friction between the sheet P and the upper belt 611 and the lower belt 612. The plurality of contact members 646 forms a curved shape of the curved surface member 643 as a whole. The plurality of contact members 646 also serves as the heating means.

Thus, the sheet P is heated by the curved surface member 643 and follows the curved shape constituted by the plurality of contact members 646. Thus, the sheet correcting device 601 can equally heat and apply tension on the portion of the sheet P on which the liquid is applied and the portion of the sheet P on which the liquid is not applied. Thus, the sheet correcting device 601 can correct the deformation such as cockling (waving) of the sheet P.

Then, as in the first and second embodiments, arranging the plurality of curved surface members 643 along the sheet conveyance direction SCD can further improve the correcting effect.

A rotating member, for example, may be rotatably provided at each of the leading ends 646*a* of the plurality of contact members 646. The rotating member can reduce a frictional resistance between each of the plurality of contact members 646 and the belt pair 602 of the plurality of contact members 646 so that the belt pair 602 can smoothly move while the belt pair 602 is in a curved (bent) state.

Next, a sheet correcting apparatus according to a fourth embodiment of the present disclosure is described with reference to FIGS. 8 and 9.

Figure 8:
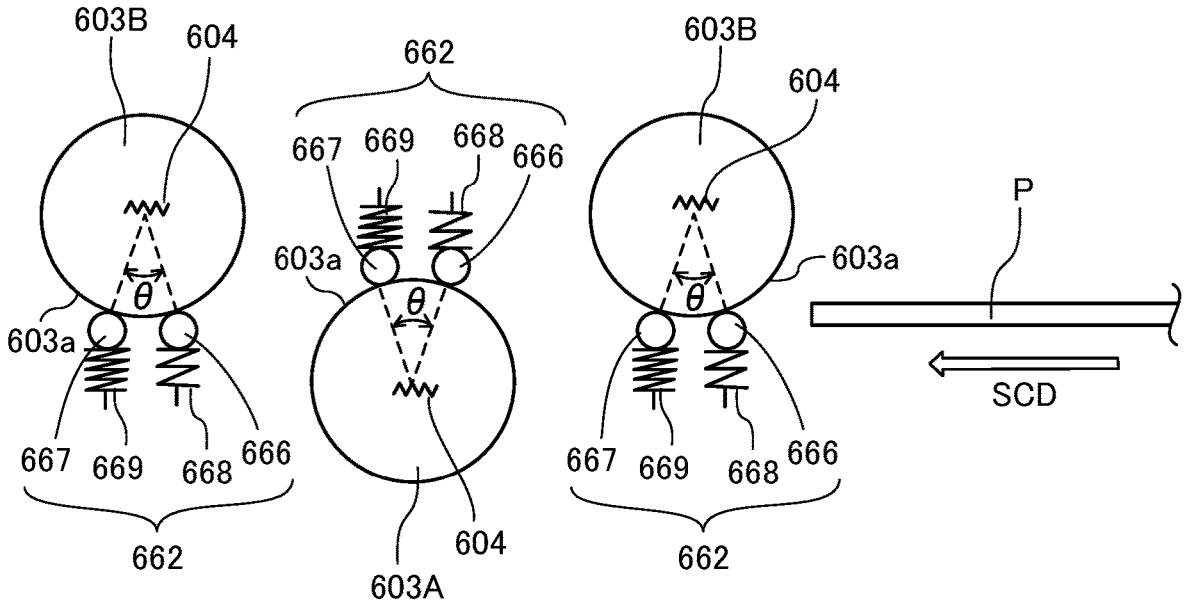
FIG. 8 is a side view of a sheet correcting device according to a fourth embodiment of the present disclosure.

FIG. 8 is a side view of the sheet correcting device 601. FIG. 9 is an enlarged side view of a portion of the sheet correcting device 601 in a state in which the sheet P is passed through the sheet correcting device 601.

In the present embodiment, as in the first embodiment, a plurality of rollers 603A and 603B for bending and deforming the sheet P is arranged alternately in the sheet conveyance direction SCD. As in the first embodiment, the plurality of rollers 603A and 603B is a heating roller also serving as a heating means.

The sheet correcting device 601 includes sheet tensioners 662 that apply a tension to the sheet P when the sheet P is bent and deformed along the curved surface 603*a* (peripheral surface) of each of the rollers 603A and 603B while the sheet P is conveyed along the sheet conveyance direction SCD. The sheet tensioners 662 also serve as a pressing unit that presses the sheet P against the curved surfaces 603*a* of the rollers 603A and 603B as the curved surface members.

Each of the sheet tensioners 662 includes tension applying rollers 666 and 667. The tension applying rollers 666 face the curved surfaces (peripheral surfaces) of the rollers 603A and 603B, respectively, and serve as first pressing members that press the sheet P against the curved surfaces 603*a* of the rollers 603A and 603B. Each of the tension applying rollers 666 is disposed on an upstream side of one of the rollers 603A and 603B in the sheet conveyance direction SCD. Similarly, the tension applying rollers 667 face the curved surfaces (peripheral surfaces) of the rollers 603A and 603B, respectively, and serve as second pressing members that press the sheet P against the curved surfaces 603*a* of the rollers 603A and 603B. Each of the tension applying rollers 667 is disposed on a downstream side of one of the rollers 603A and 603B in the sheet conveyance direction SCD. The tension applying rollers (first pressing member) 666 and (second pressing member) 667 are disposed to advanceably retractable (movable) with respect to the curved surface 603*a* (peripheral surface) of each of the rollers 603A and 603B.

In the present embodiment, the rollers 603A and 603B are rotationally driven and serve as conveyance rollers for conveying the sheet P in the sheet conveyance direction SCD.

Each of the sheet tensioners 662 includes springs 668 and 669. The springs 668 serves as first pressing members that press the tension applying rollers 666 against the curved surfaces 603*a* of the rollers 603A and 603B. The springs 669 serve as second pressing members that press the tension applying rollers 667 against the curved surfaces 603*a* of the rollers 603A and 603B.

Here, an urging force of the spring 669 (second urging member) that urges the tension applying roller 667 (second pressing member) disposed on the downstream side in the sheet conveyance direction SCD is larger than an urging force of the spring 668 (first urging member) that urges the tension applying roller 666 (first pressing member) disposed on the upstream side in the sheet conveyance direction SCD.

Thus, a pressing force of each of the tension applying roller 667 that presses the sheet P against the rollers 603A and 603B is larger than the pressing force of each of the tension applying rollers 666. The tension applying roller 667 is the second pressing member disposed on downstream side in the sheet conveyance direction SCD. The tension applying roller 666 is the first pressing member disposed on upstream side in the sheet conveyance direction SCD.

Figure 9:
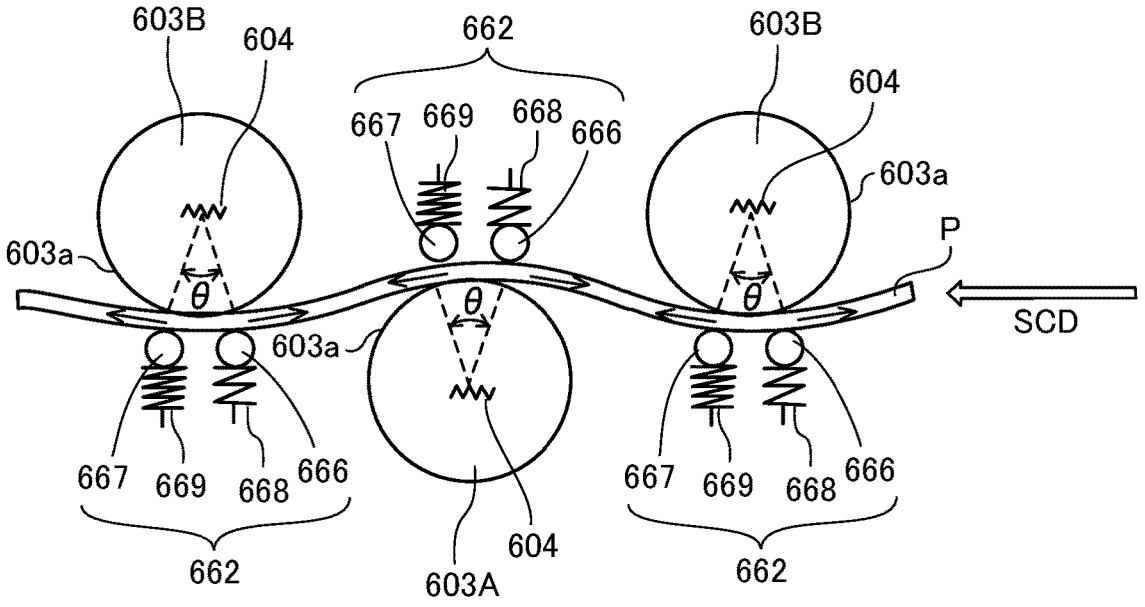
FIG. 9 is a side view of the sheet correcting device of the fourth embodiment where a sheet is passed through the sheet correcting device.

Thus, as illustrated in FIG. 9, the tension applying roller 667 disposed downstream in the sheet conveyance direction SCD presses the sheet P against the roller 603 stronger than the tension applying roller 666 disposed upstream in the sheet conveyance direction SCD. Thus, a difference occurs between forces of conveying the sheet P of the tension applying roller 666 and 667, and tension is applied to the sheet P in directions indicated by arrows in FIG. 9. Then, the sheet P is pressed against the curved surfaces 603*a* of the rollers 603A and 603B while the tension is applied to the sheet P.

Thus, as similarly to the embodiments as described above, the sheet correcting device 601 of the present embodiment can efficiently correct the deformation such as cockling (waving) of the sheet P. Further, the present embodiment can simplify the configuration of the sheet correcting device 601 since the present embodiment does not use a belt pair.

Next, a sheet correcting apparatus according to a fifth embodiment of the present disclosure is described with reference to FIGS. 10 and 11.

Figure 10:
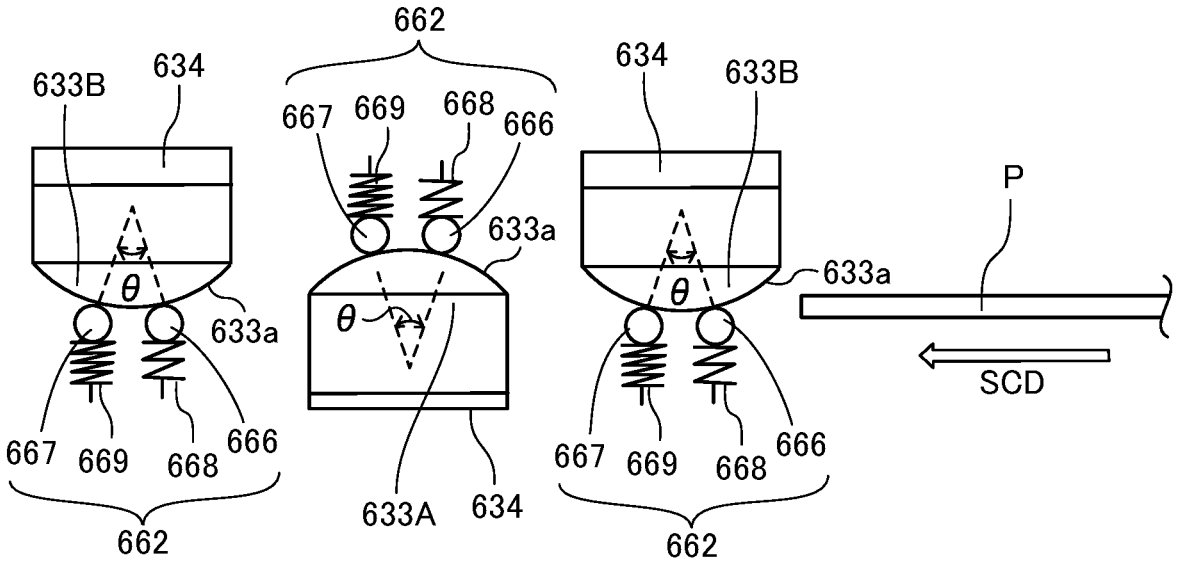
FIG. 10 is a side view of a sheet correcting device according to a fifth embodiment of the present disclosure.

FIG. 10 is a side view of the sheet correcting device 601. FIG. 11 is a side view of the sheet correcting device 601 in a state in which the sheet P is passed through the sheet correcting device 601.

In the present embodiment, curved surface members 633A and 633B that bend and deform the sheet P are arranged alternately in the sheet conveyance direction SCD as similarly to the second embodiment. The curved surface members 633A and 633B include heater portions 634, respectively, as heating means.

As similarly to the fourth embodiment, the sheet correcting device 601 includes sheet tensioners 662 for applying a tension to the sheet P when the sheet P is bent and deformed by the curved surface members 633A and 633B. The sheet tensioners 662 serve as pressing members for pressing the sheet P against the curved surfaces of the curved surface members 633A and 633B.

As similarly to the third embodiment, in the present embodiment, each of the sheet tensioners 662 includes a tension applying roller 666 serving as a first pressing member and a tension applying roller 667 serving as a second pressing member. Further, the tension applying rollers 666 and 667 serve as conveyance rollers that are rotationally driven to convey the sheet P in the sheet conveyance direction SCD.

Figure 11:
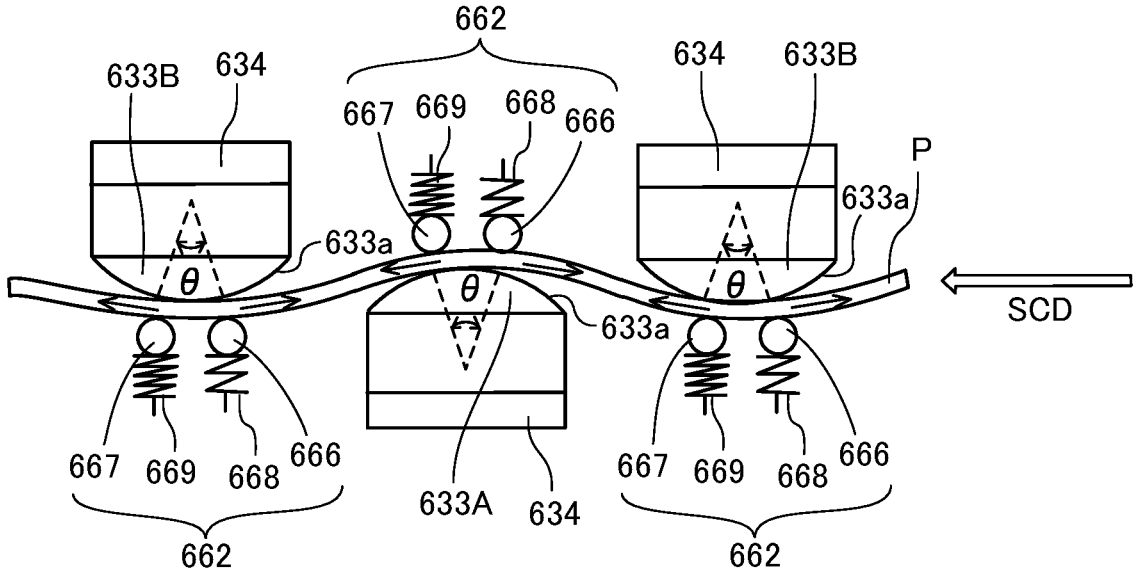
FIG. 11 is a side view of the sheet correcting device of the fifth embodiment where a sheet is passed through the sheet correcting device.

Thus, as illustrated in FIG. 11, the tension applying roller 667 disposed downstream in the sheet conveyance direction SCD presses the sheet P against the curved surface members 633A and 633B stronger than the tension applying roller 666 disposed upstream in the sheet conveyance direction SCD. Thus, a difference occurs between forces of conveying the sheet P of the tension applying roller 666 and 667, and tension is applied to the sheet P in directions indicated by arrows in FIG. 11. Then, the sheet P is pressed against the curved surfaces 633*a* of the curved surface members 633A and 633B while the tension is applied to the sheet P.

Thus, as similarly to the embodiments as described above, the sheet correcting device 601 of the present embodiment can efficiently correct the deformation such as cockling (waving) of the sheet P. Further, the present embodiment can simplify the configuration of the sheet correcting device 601 since the present embodiment does not use a belt pair.

Next, a sheet correcting device 601 according to a sixth embodiment of the present disclosure is described with reference to FIG. 12.

Figure 12:
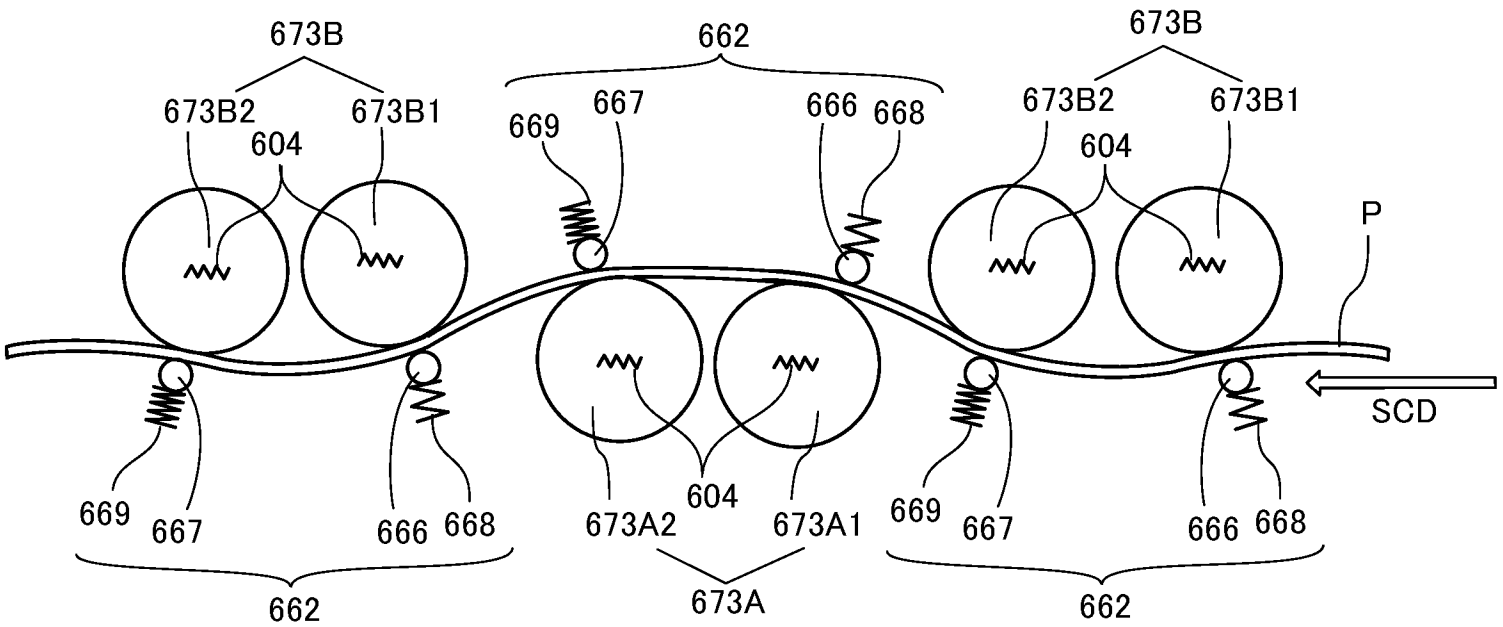
FIG. 12 is a side view in a state where a seat is passed through a seat correction device according to a sixth embodiment of the present disclosure.

FIG. 12 is a side view of the sheet correcting device 601 in a state in which the sheet P is passed through the sheet correcting device 601.

In FIG. 12, one curved surface member group 673A that bends and deforms the sheet P convexly upward contacts a back surface of the sheet P, and two curved surface member groups 673B that bend and deform the sheet P convexly downward contact a front surface of the sheet P. The curved surface member group 673 includes first rollers 673A1 and 673B1 and second rollers 673A2 and 673B2. The first rollers 673A1 and 673B1 serve as a first curved surface member and are disposed relatively upstream in the sheet conveyance direction SCD. The second rollers 673A2 and 673B2 serve as a second curved surface member and are disposed relatively downstream in the sheet conveyance direction SCD than the first rollers 673A1 and 673B1, respectively.

As similarly to the rollers 603A and 603B in the first embodiment, each of the first rollers 673A1 and 673B1 and the second rollers 673A2 and 673B2 includes a heater to serve as a heating roller that functions as heating means. The present embodiment uses the first rollers 673A1 and 673B1 and the second rollers 673A2 and 673B2 as similarly to the rollers 603A and 603B in the first embodiment as rollers (curved surface members) that constitute the curved surface member groups 673A and 673B. However, the curved surface members 633A and 633B as illustrated in FIGS. 5 and 6 of the second embodiment may also be used instead of the first rollers 673A1 and 673B1 and the second rollers 673A2 and 673B2.

Each of the sheet tensioners 662 further includes a tension applying roller 666 and a spring 668 attached to the tension applying roller 666 and a tension applying roller 667 and a spring 669 attached to the tension applying roller 667. The tension applying roller 666 and the spring 668 face the first rollers 673A1 and 673B1 disposed upstream in the sheet conveyance direction SCD. The tension applying roller 667 and the spring 669 face the second rollers 673A2 and 673B2 disposed downstream side of the first rollers 673A1 and 673B1 in the sheet conveyance direction SCD.

As similarly to the third embodiment, in the present embodiment, each of the sheet tensioners 662 serves as a pressing member to press the sheet P to the curved surface member groups 673A and 673B and includes a tension applying roller 666 serving as a first pressing member and a tension applying roller 667 serving as a second pressing member.

As in the fourth and fifth embodiments, the pressing force of the tension applying rollers 667 is larger than the pressing force of the tension applying rollers 666.

Here, the curved surface member groups 673A and 673B are arranged along the sheet conveyance direction SCD of the sheet P. The tension applying rollers 667 as the second pressing members are separated from the tension applying rollers 666 as the first pressing members among the curved surface member groups 673A and 673B adjacent in the sheet conveyance direction SCD. The tension applying rollers 667 face second curved surface members (second rollers 673A2 and 673B2) that belong to the curved surface member group 673 disposed upstream in the sheet conveyance direction SCD. The tension applying rollers 666 face first curved surface members (first rollers 673A1 and 673B1) that belong to the curved surface member group 673 disposed downstream in the sheet conveyance direction SCD.

Thus, the sheet correcting device 601 can release stress of the sheet P, which is once bent along the curved surfaces of the first rollers 673A1 and 673B1 and the second rollers 673A2 and 673B2 of the curved surface member groups 673A and 673B. Thus, the sheet correcting device 601 can improve adhesion of the sheet P to the first rollers 673A1 and 673B1 and the second rollers 673A2 and 673B2 of a next-stage.

Further, in the present embodiment, the first rollers 673A1 and 673B1 and the second rollers 673A2 and 673B2 are rotationally driven to serve as conveyance rollers that convey the sheet P in the sheet conveyance direction SCD. However, when the curved surface members 633A and 633B in the second embodiment (see FIGS. 5 and 6) are used in place of the first rollers 673A1 and 673B1 and the second rollers 673A2 and 673B2 roller 603, the tension applying rollers 666 and 667 may be rotationally driven to serve as conveyance rollers to convey the sheet P in the sheet conveyance direction SCD.

Even with such a configuration, the sheet correcting device 601 can efficiently correct the deformation of the sheet as in the above-described embodiments.

Thus, the sheet correcting device 601 includes a plurality of curved surface member groups 673A and 673B each including the first curved surface member (first rollers 673A1 and 673B1) and the second curved surface member (second rollers 673A2 and 673B2). A first group of the plurality of curved surface member groups 673A bends the sheet convexly upward, a second group of the plurality of curved surface member groups 673B bends the sheet convexly downward, and the first group (673A) and the second group (673B) are disposed alternately along the sheet conveyance direction SCD.

Next, a sheet correcting device 601 according to a seventh embodiment of the present disclosure is described with reference to FIG. 13.

Figure 13:
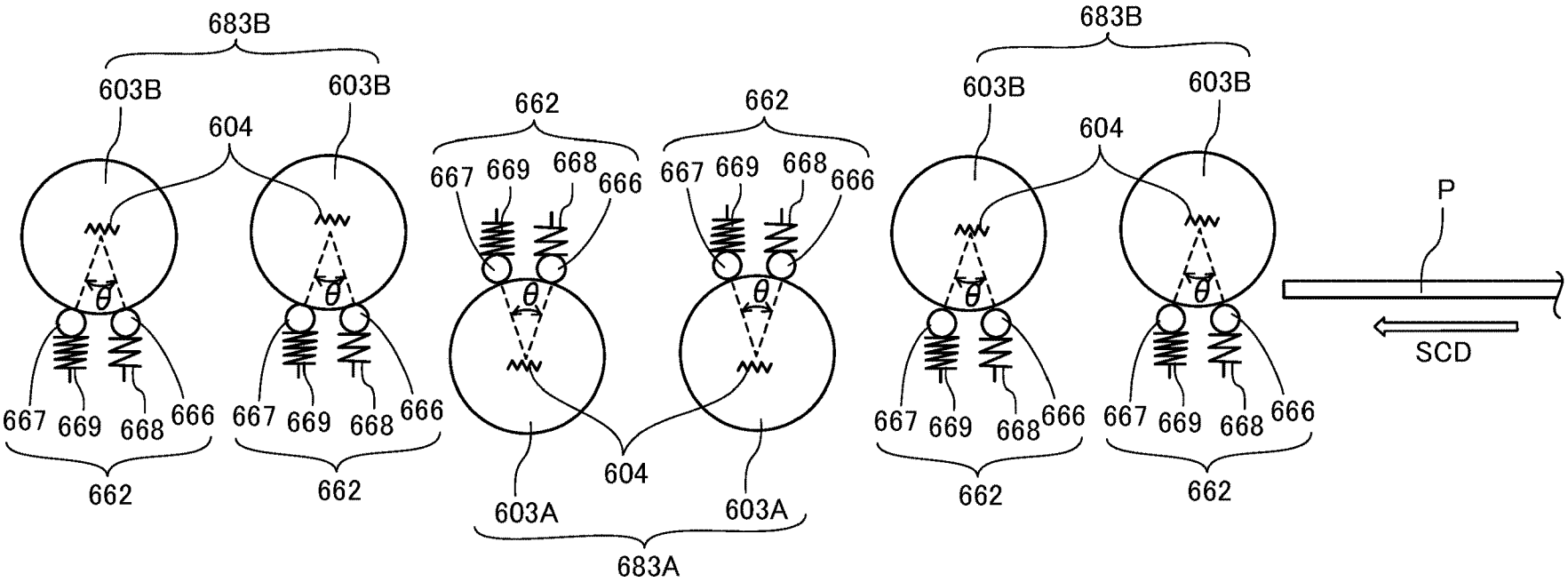
FIG. 13 is a side view of a sheet correcting device according to a seventh embodiment of the present disclosure.

FIG. 13 is a side view of the sheet correcting device 601.

In the present embodiment, a roller group 683A and roller groups 683B are alternately arranged in the sheet conveyance direction SCD. The roller group 683A includes two rollers 603A that bend and deform one surface of the sheet P convexly upward. The roller groups 683B include two rollers 603B that bend and deform the other surface of the sheet P convexly downward (see FIG. 14).

Each of the roller groups 683A and 683B may be a group of three or more rollers 603A and 603B. In FIG. 13, the rollers 603B of the roller group 683B are arranged at the most upstream in the sheet conveyance direction SCD. However, the rollers 603A of the roller group 683A may be arranged at the most upstream in the sheet conveyance direction SCD. The rollers 603A of the roller group 683A and the rollers 603B of the roller group 683B are alternately arranged in the sheet conveyance direction SCD.

As in the first embodiment, the plurality of rollers 603A and 603B is a heating roller also serving as a heating means. Each of the sheet tensioners 662 includes a tension applying roller 666 and 667. The tension applying rollers 666 face the curved surface (peripheral surface) of the rollers 603A and 603B, respectively, and serves as first pressing members that press the sheet P against the curved surfaces 603*a* of the rollers 603A and 603B. The tension applying rollers 666 are disposed on an upstream side in the sheet conveyance direction SCD of each of the rollers 603A and 603B. Similarly, the tension applying rollers 667 face the curved surface (peripheral surface) of rollers 603A and 603B, respectively, and serve as second pressing members that press the sheet P against the curved surfaces 603*a* of the rollers 603A and 603B.

The tension applying rollers 667 are disposed on a downstream side in the sheet conveyance direction SCD of each of the rollers 603A and 603B. As in the fourth embodiment (see FIG. 8), the sheet correcting device 601 includes sheet tensioners 662 that include springs 668 and 669, respectively. The springs 668 serves as first pressing members that press the tension applying rollers 666 against the curved surfaces 603*a* of the rollers 603A and 603B. The springs 669 serve as second pressing members that press the tension applying rollers 667 against the curved surfaces 603*a* of the rollers 603A and 603B. In the present embodiment, the rollers 603A and 603B in the first embodiment (see FIG. 2) are used as the curved surface members. However, the curved surface member in the second embodiment (see FIG. 5) may also be used as the curved surface members.

In the present embodiment, the rollers 603A and 603B are rotationally driven and serve as conveyance rollers to convey the sheet P in the sheet conveyance direction SCD. However, when the curved surface members 633A and 633B in the second embodiment (see FIGS. 5 and 6) are used in place of the rollers 603A and 603B in the present embodiment, the tension applying rollers 666 and 667 may be rotationally driven to serve as conveyance rollers to convey the sheet P in the sheet conveyance direction SCD.

Thus, one surface of the sheet P is bent and deformed to be convex one of upward and downward to be corrected twice. Then, the other surface of the sheet P is bent and deformed to be convex the other of upward and downward to be repeatedly corrected twice.

Thus, the sheet correcting device 601 can efficiently correct the deformation such as cockling (waving) of the sheet P.

The arrangement of the rollers in the sixth embodiment and the seventh embodiment may also be applied to the first embodiment.

Next, a sheet correcting device 601 according to an eighth embodiment of the present disclosure is described with reference to FIG. 14.

Figure 14:
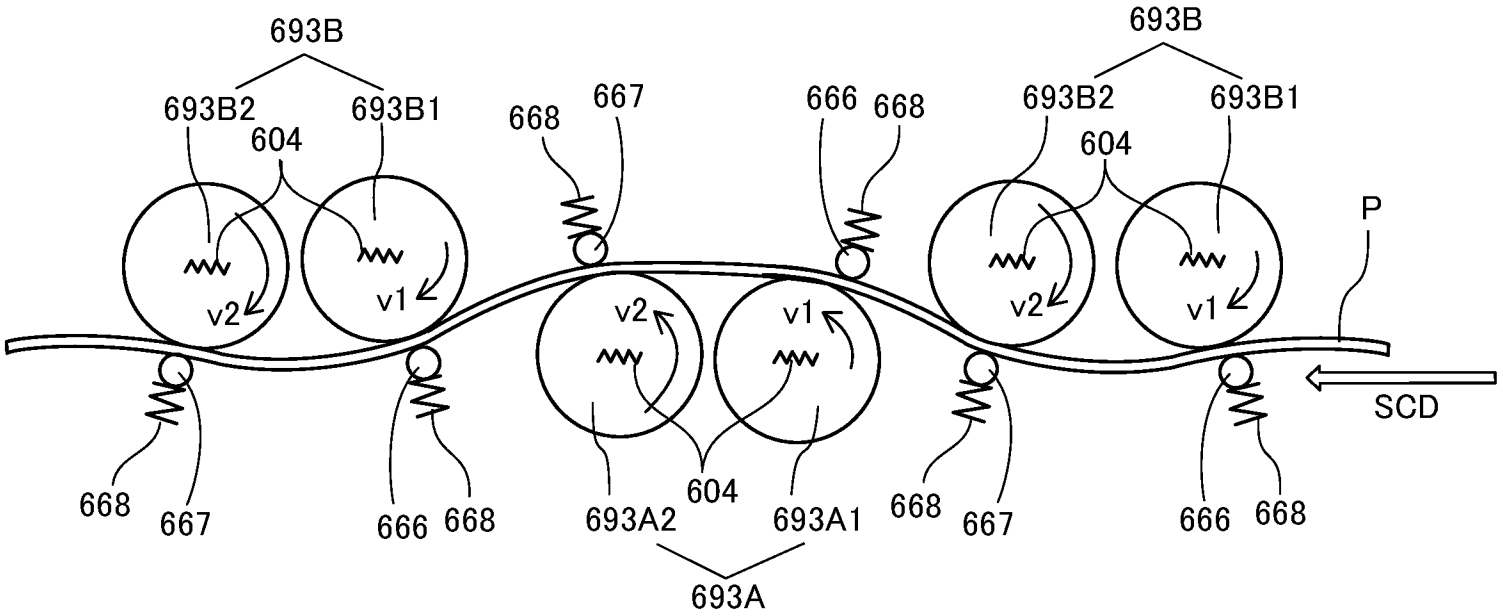
FIG. 14 is a side view of a sheet correcting device according to an eighth embodiment of the present disclosure.

FIG. 14 is a side view of the sheet correcting device 601.

In the present embodiment, similarly to the sixth embodiment (see FIG. 12), a curved surface member 693A that bends and deforms the sheet P includes a plurality of rollers 693A1 and 693A2. Further, each of curved surface members 693B that bends and deforms the sheet P includes a plurality of rollers 693B1 and 693B2. The number of the rollers 693A1 and 693A2 included in the curved surface member 693A is not limited to two as in FIG. 14 but may be three or more. Further, the number of the rollers 693B1 and 693B2 included in the curved surface member 693B is not limited to two as in FIG. 14 but may be three or more.

As similarly to the rollers 603A and 603B in the first embodiment (see FIG. 2), each of the rollers 693A1 and 693A2 and the rollers 693B1 and 693B2 includes a heater to serve as a heating roller that functions as heating means.

Further, each of the rollers 693A1 and 693A2 and the rollers 693B1 and 693B2 are rotationally driven to convey the sheet P in the sheet conveyance direction SCD.

The sheet correcting device 601 includes a tension applying roller 666 facing the rollers (curved surface members) 693A1 and 693B1 and a tension applying roller 667 facing the rollers (curved surface members) 693A2 and 693B2. The tension applying rollers 666 presses the sheet P against each curved surfaces of the rollers 693A1 and 693B1 disposed upstream in the sheet conveyance direction SCD. The tension applying rollers 667 presses the sheet P against each curved surfaces of the rollers 693A2 and 693B2 disposed downstream side of the rollers 693A1 and 693B1, respectively, in the sheet conveyance direction SCD.

Both the tension applying rollers 666 and 667 are urged by a spring 668.

In this embodiment, a rotation speed v2 of the rollers 693A2 and 693B2 disposed downstream in the sheet conveyance direction SCD is faster than a rotation speed v1 of the rollers 693A1 and 693B1 disposed upstream side of the rollers 693A2 and 693B2 in the sheet conveyance direction SCD in each of the curved surface members 693A and 693B (v2>v1).

Thus, a difference occurs between forces of conveying the sheet P of the rollers 693A1 and 693B1 and the forces of the rollers 693A2 and 693B2 disposed downstream side of the rollers 693A1 and 693B1, respectively, in the sheet conveyance direction SCD. Thus, the sheet correcting device 601 can apply tension on the sheet P.

Even with such a configuration, the sheet correcting device 601 can efficiently correct the deformation of the sheet P as in the above-described embodiments. Further, the same spring 668 may be used as urging means for urging the tension applying roller 666 against the curved surface of the rollers 693A1 and 693B1 and for urging the tension applying roller 667 against the curved surface of the rollers 693A2 and 693B2.

Figure 15A:
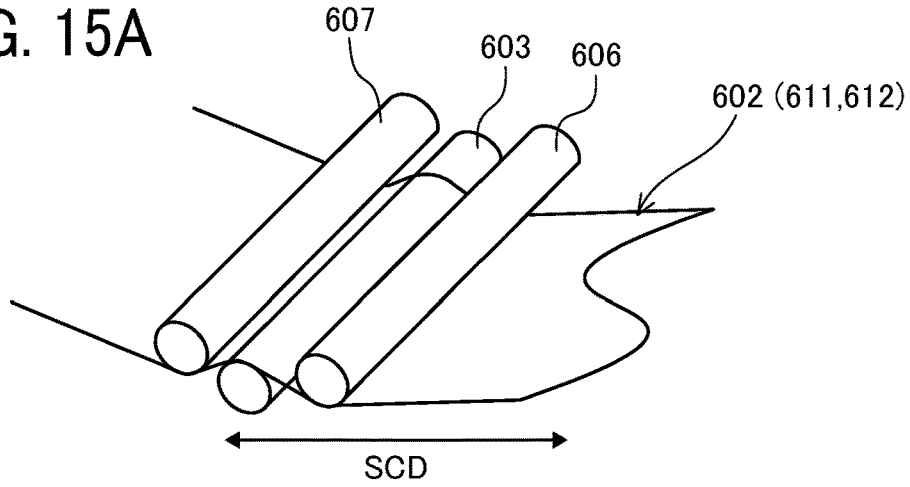
FIGS. 15A through 15C are perspective views of curved surface members and belt pairs of different examples.
Figure 15B:
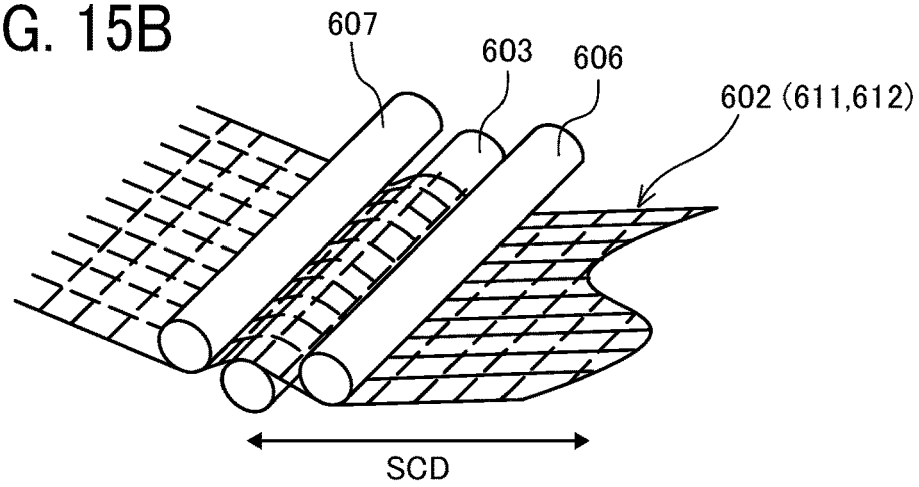
Figure 15C:
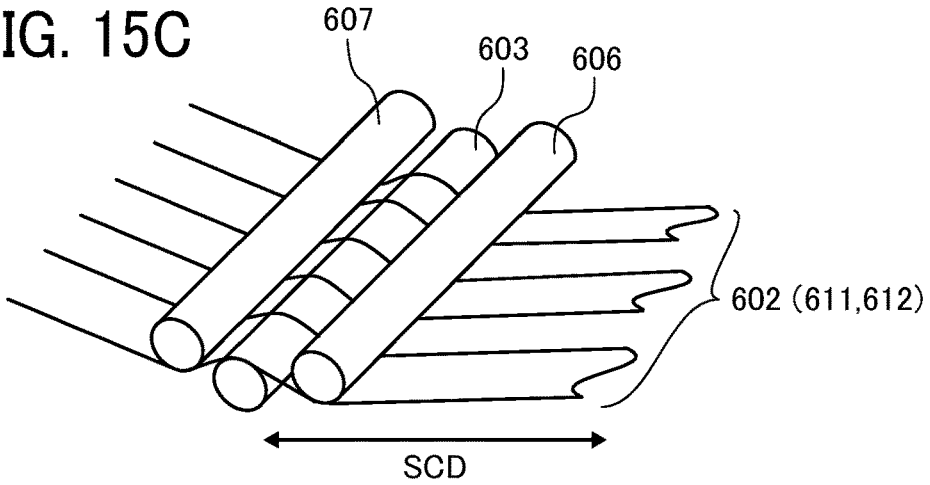

FIGS. 15A through 15C illustrate examples of belt pairs in the embodiments using the belt pair. FIGS. 15A through 15C are perspective views of the belt pairs at portions of curved surface members.

In FIG. 15A, the upper belt 611 and the lower belt 612 that form the belt pair 602 are full-surface belts that can cover the entire surface of the sheet P. In FIG. 15B, the upper belt 611 and the lower belt 612 that form the belt pair 602 are mesh belts. In FIG. 15C, the upper belt 611 and the lower belt 612 that form the belt pair 602 are divided belts in which a belt is divided into multiple rows of belts in a direction perpendicular to the sheet conveyance direction SCD.

Any of the upper belt 611 and the lower belt 612 forming the belt pair 602 illustrated in FIGS. 15A through 15C may be used in the present embodiment.

When the upper belt 611 and the lower belt 612 that form the belt pair 602 are the mesh belts illustrated in FIG. 15B or the divided belts illustrated in FIG. 15C, the moisture in the sheet P is evaporated by heating the liquid attached to the sheet P. Then, the evaporated moisture escapes from gaps in the mesh belt or gaps between the divided belt. Thus, an effect of heating the sheet P in the mesh belt (see FIG. 15B) and the divided belt (see FIG. 15C) is increased compared to the full-surface belt (see FIG. 15A).

Figure 16:
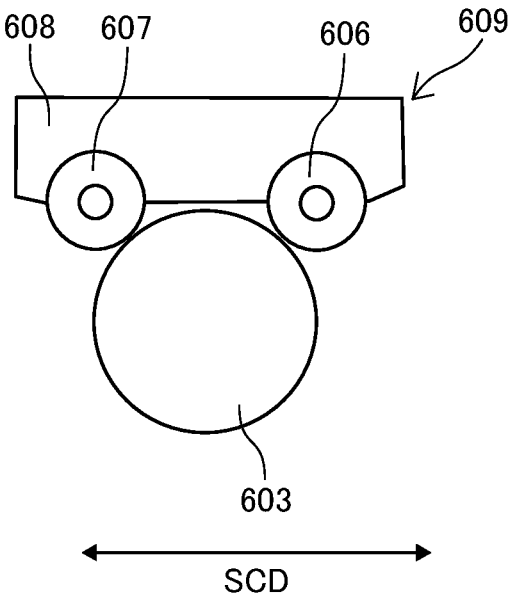
FIG. 16 is a side view of a vicinity of a curved surface member formed together with a pressing member as a single unit.

FIG. 16 illustrates a combination of the first pressing member 606 and the second pressing member 607 in the above-described embodiments. FIG. 16 is a cross-sectional view of a first pressing member 606 and a second pressing member 607 in a vicinity of a curved surface member (rollers 603).

The first pressing member 606 and the second pressing member 607 that face the roller 603 (or the curved surface member 633) as curved members are rotatably held by the holder member 608, for example, to form a pressing member unit 609.

In this manner, the first pressing member 606 and the second pressing member 607 are formed into a single unit. The first pressing member 606 and the second pressing member 607 may be advanceably retractable to the roller 603 (or the curved surface member 633) to simplify a configuration of advancing and retracting the first pressing member 606 and the second pressing member 607.

Further, an embodiment in which the tension applying roller is used as the first pressing members and second pressing members, the tension applying rollers 666 and 667 and the springs 668 and 669 may be formed into a single unit.

Figure 17:
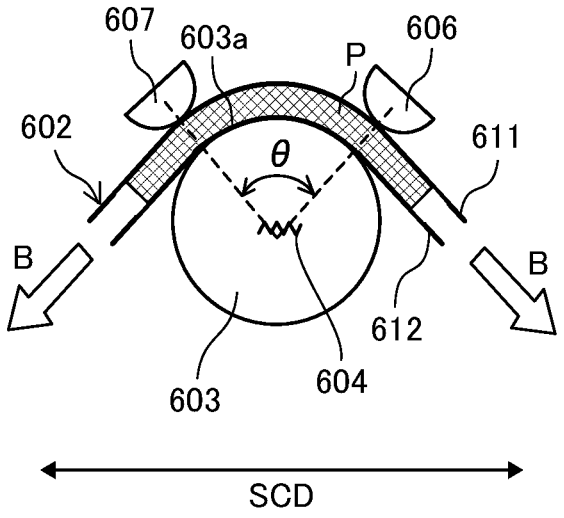
FIG. 17 is a cross-sectional view of a vicinity of the curved surface member in another example of pressing member of the present embodiment.

Next, another example of the pressing member is described with reference to FIG. 17, which is a cross-sectional view of a first pressing member 606 and a second pressing member 607 in a vicinity of a curved surface member (rollers 603).

Here, a first pressing member 606 and a second pressing member 607 having a semicircular cross section are used.

In this way, the first pressing member and the second pressing member are not limited to the roller, and either one of the first pressing member and the second pressing member may be formed in a roller and the other in a semicircular.

In each of the above-described embodiments, the sheet correcting device has been described as an example in which the sheet is conveyed in a horizontal direction (lateral direction). Alternatively, the sheet P may be conveyed in a vertical direction or an oblique direction.

Numerous additional modifications and variations are possible in light of the above teachings. It is therefore to be understood that, within the scope of the above teachings, the present disclosure may be practiced otherwise than as specifically described herein. With some embodiments having thus been described, it is obvious that the same may be varied in many ways. Such variations are not to be regarded as a departure from the scope of the present disclosure and appended claims, and all such modifications are intended to be included within the scope of the present disclosure and appended claims.

What is claimed is:

1. A sheet correcting device, comprising:

a plurality of curved surface members including curved surfaces, respectively, to deform a sheet along the curved surfaces, the plurality of curved surface members disposed along a conveyance direction of the sheet;

a belt pair, including a first belt and a second belt to sandwich the sheet between the first belt and the second belt to convey the sheet in the conveyance direction;

a plurality of pressing member groups disposed facing the curved surfaces of the plurality of curved surface members via the belt pair, respectively, to press the belt pair against the curved surfaces of the plurality of curved surface members, respectively; and a heater to heat the sheet that is deformed by the curved surfaces of the plurality of curved surface members; and each of the plurality of pressing member groups including:

a first pressing member to press the belt pair against one of the curved surfaces; and a second pressing member separate from the first pressing member and disposed adjacent to and upstream from the first pressing member of a corresponding pressing member group in the conveyance direction to press the belt pair against another of the curved surfaces, wherein the first belt and the second belt are disposed to sandwich the sheet from the second pressing member of a first pressing member group to a first pressing member of the first pressing member group, wherein the first belt and the second belt are disposed to sandwich the sheet from the second pressing member of a second pressing member group to a first pressing member of the second pressing member group, wherein the first pressing member of the first pressing member group and the second pressing member of the second pressing member group press the belt pair against a same one of the plurality of the curved surfaces.

2. The sheet correcting device according to claim 1, wherein the plurality of curved surface members comprises a first curved surface member that bends the sheet convexly upward and a second curved surface member that bends the sheet convexly downward, and the first curved surface member and the second curved surface member are alternately disposed along the conveyance direction.

3. The sheet correcting device according to claim 1, wherein the plurality of curved surface members comprises a plurality of first curved surface members successively disposed to bend the sheet convexly upward and a plurality of second curved surface members successively disposed to bend the sheet convexly downward, and the plurality of first curved surface members is disposed next to the plurality of second curved surface members.

4. The sheet correcting device according to claim 1, wherein one of the plurality of curved surface members and another of the plurality of curved surface members disposed adjacent to and downstream from the one of the plurality of curved surface members in the conveyance direction are arranged at an interval at which the sheet is held straight between the first pressing member facing the another of the plurality of curved surface members and the second pressing member disposed upstream of the first pressing member in the conveyance direction and facing the one of the plurality of curved surface members.

5. The sheet correcting device of claim 1, wherein the first belt is an upper belt and the second belt is a lower belt.

6. The sheet correcting device according to claim 5, further comprising:

a belt tensioner that applies a tensile force to the upper belt and the lower belt, respectively, in a direction in which each of belt surfaces of the upper belt and the lower belt of the belt pair that holds the sheet is pulled toward both upstream and downstream of the sheet in the conveyance direction.

7. The sheet correcting device according to claim 1, further comprising:

a first urging member that urges the first pressing member to press the sheet against the curved surfaces; and a second urging member that urges the second pressing member to press the sheet against the curved surfaces, wherein the first urging member, the second urging member, the first pressing member, and the second pressing member form a sheet tensioner, and an urging force of the second urging member is larger than an urging force of the first urging member.

8. The sheet correcting device according to claim 1, wherein each of the plurality of curved surface members is a roller.

9. The sheet correcting device according to claim 1, wherein each of the plurality of curved surface members includes a plurality of contact members disposed along the conveyance direction, and a leading end of one of the plurality of contact members disposed at a center in the conveyance direction protrudes beyond leading ends of the plurality of contact members disposed at both ends in the conveyance direction.

10. The sheet correcting device according to claim 1, wherein at least one of the first pressing member and the second pressing member is movable toward and away from the curved surface of a corresponding one of the plurality of curved surface members.

11. The sheet correcting device according to claim 1, wherein at least one of the first pressing member and the second pressing member is a roller.

12. The sheet correcting device according to claim 1, wherein the sheet correcting device corrects the sheet after a printing process and a drying process are performed on the sheet.

13. The sheet correcting device according to claim 1, wherein:

the plurality of pressing member groups presses the sheet against the plurality of curved surfaces for a plurality of times via the first belt and the second belt while conveying the sheet.

14. A printer comprising:

a liquid application device to apply liquid to a sheet; and the sheet correcting device according to claim 1, wherein the sheet correcting device is disposed downstream of the liquid applying device in the conveyance direction.

15. The printer according to claim 14, further comprising a drying apparatus to dry the sheet, disposed between the liquid application device and the sheet correcting device.

16. The printer according to claim 14, wherein the liquid application device is configured to discharge ink onto the sheet to form an image on the sheet.

17. A sheet correcting device, comprising:

a plurality of curved surface members including curved surfaces, respectively, to deform a sheet along the curved surfaces, the plurality of curved surface members disposed along a conveyance direction of the sheet;

a belt pair, including a first belt and a second belt to sandwich the sheet between the first belt and the second belt to convey the sheet in the conveyance direction;

a plurality of pressing members disposed facing the curved surfaces of the plurality of curved surface members via the belt pair, respectively, to press the belt pair against the curved surfaces of the plurality of curved surface members, respectively; and a heater to heat the sheet that is deformed by the curved surfaces of the plurality of curved surface members; and each of the plurality of pressing members including:

a first pressing member to press the belt pair against one of the curved surfaces; and a second pressing member separate from the first pressing member and disposed adjacent to and downstream of the first pressing member in the conveyance direction to press the belt pair against another of the curved surfaces, wherein:

the plurality of pressing members presses the sheet against the plurality of curved surfaces for a plurality of times via the first belt and the second belt while conveying the sheet, the plurality of curved surface members includes a first curved surface contacting the first belt, and a second curved contacting the second belt, the first curved surface and the second curved surface are disposed opposite to each other via the belt pair, the plurality of pressing members includes a first set of the first pressing member and the second pressing member configured to press the first curved surface via the belt pair, and a second set of the first pressing member and the second pressing member configured to press the second curved surface via the belt pair, and the first set and the second set are disposed opposite to each other via the belt pair.

* * * * *